United States Patent [19]

Scully

[11] Patent Number: 4,715,754

[45] Date of Patent: Dec. 29, 1987

[54] TIEDOWN ASSEMBLY

[75] Inventor: Andrew J. Scully, Macomb, Mich.

[73] Assignee: The United States of America as represented by the Secretary of the Army, Washington, D.C.

[21] Appl. No.: 875,899

[22] Filed: Jun. 18, 1986

[51] Int. Cl.[4] ..... B61D 45/00

[52] U.S. Cl. ..... 410/107; 410/111; 410/101; 296/40

[58] Field of Search ..... 410/101, 102, 103, 106–116; 296/40

[56] References Cited

U.S. PATENT DOCUMENTS 483,187 9/1892 Turner ..... 126/83

FOREIGN PATENT DOCUMENTS 571635 3/1959 Canada ..... 410/112

OTHER PUBLICATIONS

Parts Catalog for the Auto-Loader, Evans Products Co., sheet No. 305, Jun. 1936.

*Primary Examiner*—Kenneth J. Dorner
*Assistant Examiner*—Gerald A. Anderson
*Attorney, Agent, or Firm*—Peter A. Taucher; John E. McRae

[57] ABSTRACT

In a flat bed cargo vehicle having a series of upwardly-opening pockets spaced therealong, and cargo tie-down anchor members swingably disposed therein: the improvement wherein each pocket has a porous bottom wall permitting water to drain out of the pocket; each said bottom wall comprising a series of baffles preventing flames in the zone beneath the pocket from travelling directly upwardly through the pores defined by the baffles, to detonate ammunition located on the bed.

3 Claims, 4 Drawing Figures

TIEDOWN ASSEMBLY

GOVERNMENT INTEREST

The invention described herein may be manufactured, used, and licensed by or for the Government for governmental purposes without payment to me of any royalty thereon.

BACKGROUND AND SUMMARY OF THE INVENTION

This invention relates to tie-down mechanisms for cargo arranged on flat bed trucks or trailers.

Under conventional practice chains or straps are used to retain cargo in place on truck or trailer beds. End areas of the chains or straps are connected to anchor members located in pockets spaced along outer side areas of the beds. Each anchor member can take the form of a swingable bail or shackle that is oriented in the pocket so that it can be swung up out of the pocket for connection to the strap or swung down into the pocket when not in use.

The above-mentioned pockets are exposed to the weather such that rain, dirt, snow and other debris can collect therein. Under arctic conditions ice can form in the pockets, making it difficult to operate the anchor members between their upright (use) positions and their retracted (non-use) positions. The problem has been partially solved by forming drain openings in the pocket bottom walls.

The drain openings in the pocket bottom walls pose a problem when the truck or trailer is being used by the military to carry ammunition. Should the truck or trailer be operating in a battle zone there may be hot burning materials on the ground in the vehicle path. There is a possibility that flames originating beneath the vehicle can travel upwardly through the drain openings in the aforementioned pockets, to thus impinge on surface areas of ammunition containers (or unboxed ammunition) resting on the vehicle bed. This action might explode the ammunition, with resultant loss of life.

The present invention is directed to a tie-down anchor mechanism for cargo, especially ammunition or flammable materials, wherein the pockets for the tie-down anchor members are constructed so that water can readily drain through the pocket bottom walls; the pocket bottom walls are formed as a series of overlapped baffle plates arranged to resist upflow of flames from beneath the vehicle into the pockets.

THE DRAWINGS

Referring in greater detail to the drawings, there is fragmentarily shown a bed area 10 of a cargo-carrying vehicle (truck or trailer). Bed area 10 comprises two metal side rails running longitudinally along outer side areas of the bed, i.e. parallel to the vehicle longitudinal axis; one of the rails is shown at 12 in FIGS. 1 and 2.

Deck boards 14 extend across the space between the side rails to form the support surface for cargo.

Figure 1:
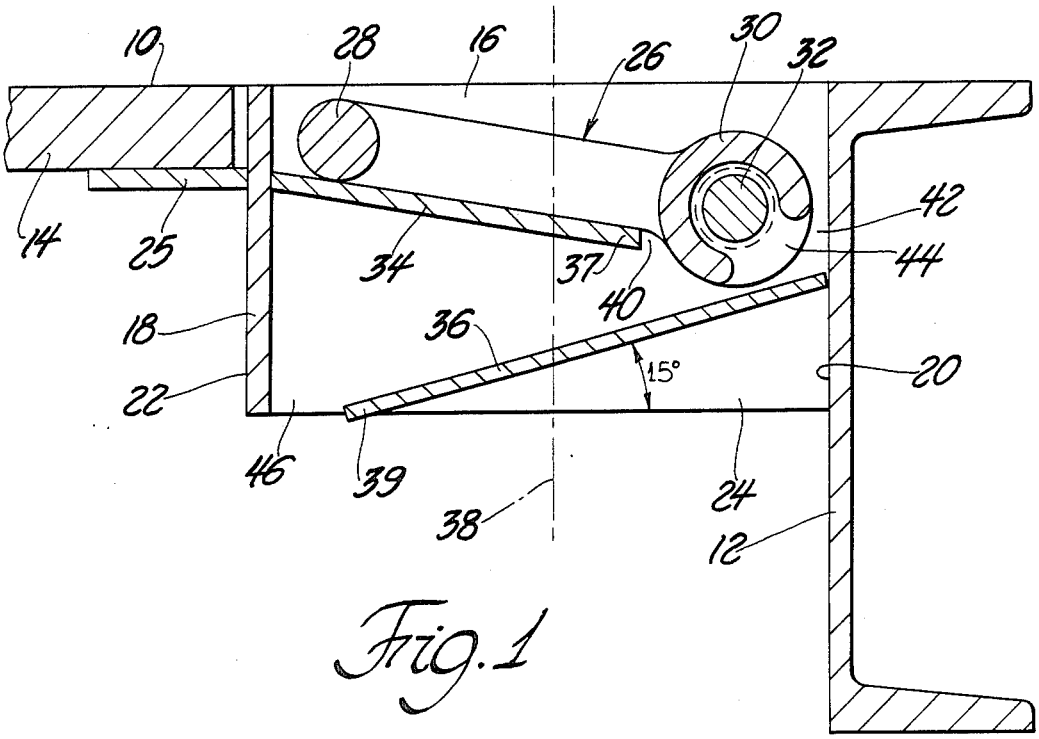
FIG. 1 is a sectional view taken on line 1—1 in FIG. 2, and illustrating certain features of an anchor mechanism constructed according to the invention.
Figure 2:
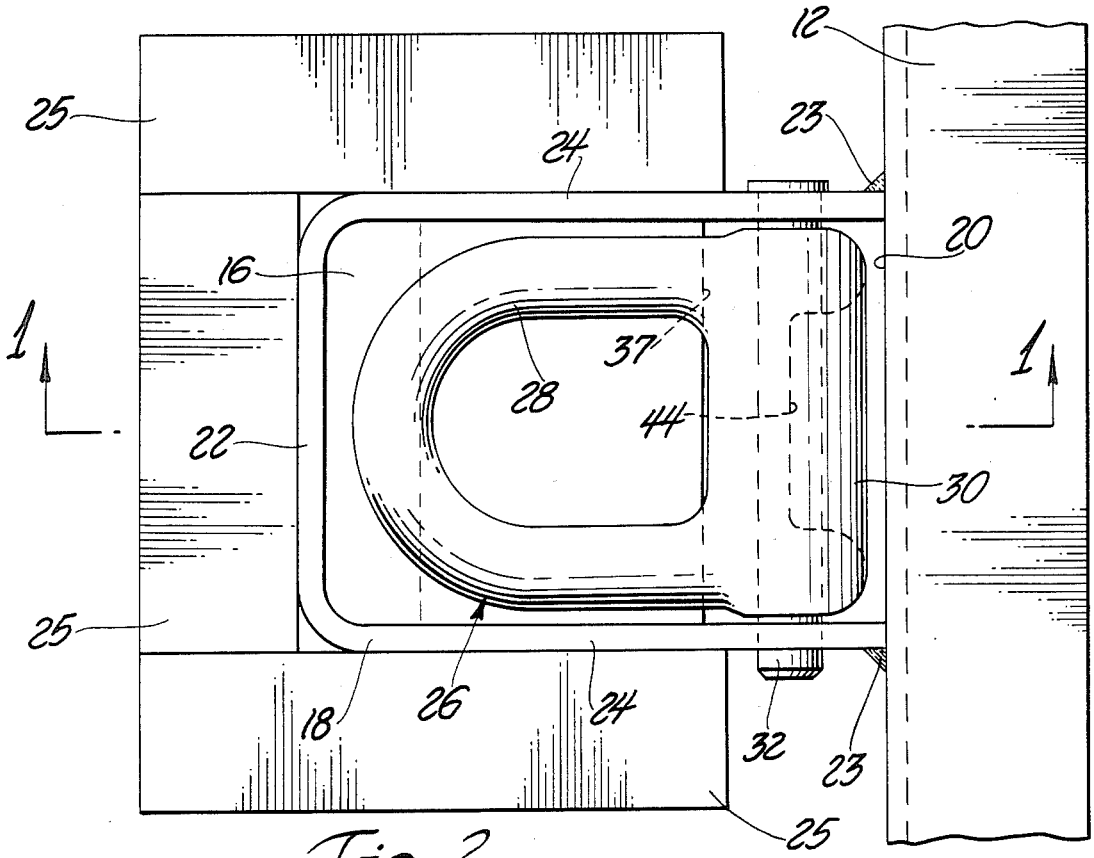
FIG. 2 is plan view of the FIG. 1 mechanism, with deck boards removed to show details of the anchor mechanism.

A number of anchoring mechanisms are provided on each side rail 12 to anchor the ends of straps or chains that are used to hold the cargo against shifting on bed area 10. FIGS. 1 and 2 illustrate one of the anchoring mechanisms. Similar mechanisms would be provided at other points along each side rail 12.

The illustrated anchoring mechanism comprises an upwardly-opening pocket structure 16 formed by an upright channel member 18 and an inner surface area 20 of rail 12. Channel member 18 includes a web wall 22 extending parallel to rail surface 20, and flange walls 24 extending from wall 22 to the rail surface; member 18 may be fixed to rail 12 by welding, as at 23. As an optional feature, horizontal deck-support plates 25 may be welded to outer surface areas of channel member 18.

It can be seen from FIG. 2 that pocket structure 16 is generally rectangular in plan configuration. The space between wall 22 and surface 20 defines the length (major) dimension of the pocket; the space between walls 24 forms the width dimension of the pocket.

Figure 3:
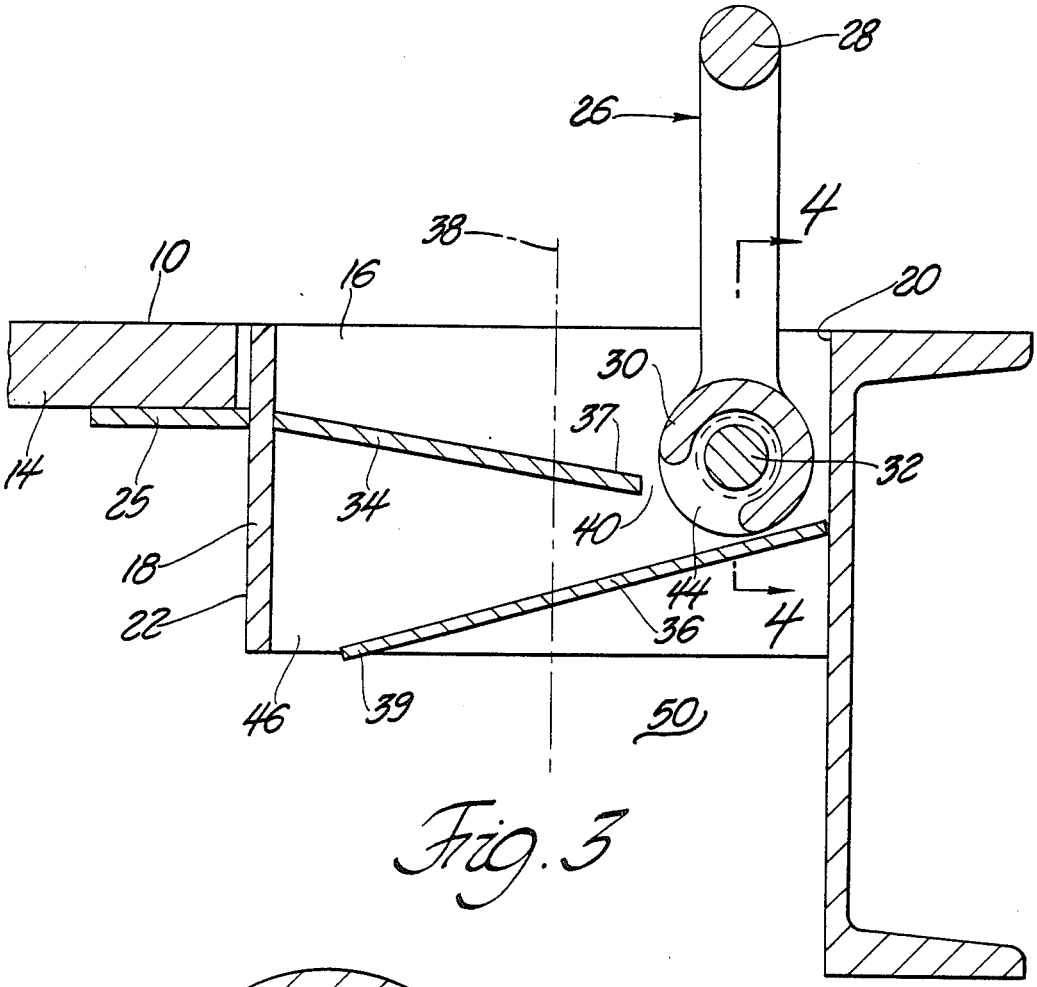
FIG. 3 is a sectional view taken in the same direction as FIG. 1, but with the tie-down anchor member (shackle) adjusted to an upright (use) position.

Pocket structure 16 forms a mounting mechanism for a swingable tie-down anchor member 26. Member 26 includes a loop section 28 designed to connect with a non-illustrated cargo tie-down strap, and a hub section 30 designed to rotate on a pin or shaft 32. Shaft 32 may have a press fit in circular openings formed in channel walls 24. Anchor member 26 can swing between a retracted position entirely within pocket 16 (FIG. 1) and a "use" position extending partly out of the pocket (FIG. 3).

The bottom wall for pocket structure 16 is defined by two inclined plates or walls 34 and 36. Upper plate 34 extends rightwardly from web wall 22 to a point beyond the imaginary vertical mid plane 38 of the pocket structure. Lower plate 36 extends leftwardly from rail surface 20 to a point beyond the imaginary vertical midplane 38. The free edge areas 37 and 39 of the two plates overlap one another in the vertical direction (as seen in FIG. 1).

Plates 34 and 36 span the entire distance between channel walls 24. Any water collecting on the upper surface of plate 34 gravitates toward hub section 30 of anchor member 26. The inclination of each plate, 34 or 36, may vary within limits without adverse effect on drainage action. Preferred angle of inclination is in the range of ten to twenty degrees. As shown, plate 34 has an inclination angle of about ten degrees; plate 36 has an inclination angle of about fifteen degrees.

Pivot shaft 32 and the associated hub section 30 are located in the space between free edge 37 of plate 34 and pocket side surface 20, such that loop section 28 of anchor member 26 rests on the upper face of plate 34 when member 26 is in its retracted position (FIG. 1). Support shaft 32 for anchor member 26 is located relatively close to rail 12, which is a high strength member of substantial proportions; anchor member 26 is thus well adapted to serve its anchoring function.

Hub section 30 has a diameter that is only slightly less than the distance between edge 37 of plate 34 and pocket surface 20. A relatively small clearance space 40 is formed between hub section 30 and the adjacent edge of plate 34. Another small clearance space 42 is formed between the hub section and pocket surface 20. Each clearance space, 40 or 42, may have a width dimension on the order of one eighth inch.

As best seen in FIG. 2, hub section 30 has a length almost as great as the spacing between pocket side walls 24. Therefore, any water collecting in pocket 26 is discharged primarily through clearance slots 40 and 42; however, some slight water flow can be accommodated through the clearance areas at the ends of hub section 30. The inclinations taken by plates 34 and 36 promote water flow and thus preclude stagnant water pools that could rust out the pocket structure.

Figure 4:
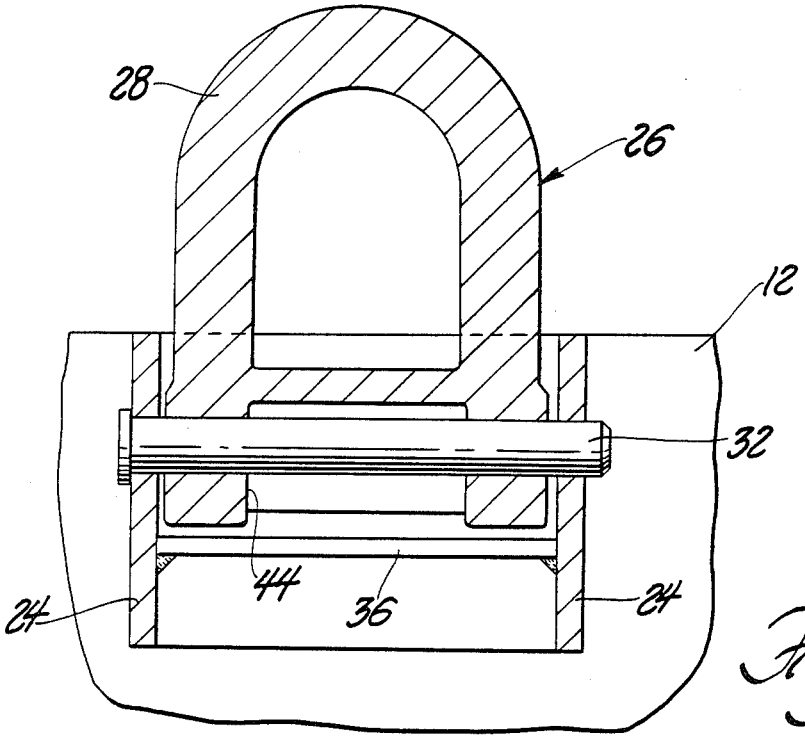
FIG. 4 is a sectional view on line 4—4 in FIG. 1.

The undersurface area of hub section 30 is relatively close to lower plate 36, such that debris could perhaps collect in the restricted space. To minimize the potential for such debris collection, the undersurface of hub section 30 is formed with a localized recess 44. Recess 44 extends for a substantial portion of the hub section length, as shown in FIG. 4. The recess extends a sufficient circumferential distance around pivot shaft 32 that the recess faces plate 36, whether anchor member 26 is in the retracted position (FIG. 1) or the use position (FIG. 3).

Recess 44 and clearance spaces 40 and 42 should be sized to permit downflow of water, dirt and similar debris onto plate 36 for eventual discharge through space 46. However, the clearance spaces 40 and 42 should be no larger than necessary for the drainage function. Discharge space 46 could be somewhat smaller than as shown in FIGS. 1 and 3, without adverse effects.

Clearance spaces 40 and 42 are kept reasonably small in order that plates 34 and 36 can act as baffles opposing flame travel from zone 50 below the pocket structure to the space above plate 34.

In order for a flame in zone 50 to reach the space above plate 34 the flame must travel upwardly through space 46, then make a right turn into the funnel-like zone above plate 36. Flames in the funnel-like zone will impinge against hub section 30; the hub section thus forms a barrier or obstruction to flame flow.

Theoretically the flame could flow around hub section 34 through clearance spaces 40 and 42. However, if these spaces are made sufficiently small such flame travel is unlikely. Additionally, hub section 30 is a metal casting (or forging) having a relatively large metal mass, such that it has a quenching effect on the impinging flames. Flame travel is resisted by the baffle-like configuration of drainage plates 34 and 36, and also by the location of hub section 30 in the space between edge 37 of plate 34 and pocket side surface 20. Hub section 30 cooperates with baffle plates 34 and 36 to form a tortuous path tending to obstruct flame travel in an up direction.

Resistance to flame travel is substantially the same, whether anchor member 26 is in its retracted position (FIG. 1) or its use position (FIG. 3). As far as I know, there is no known prior art arrangement providing the water drainage capability and flame obstruction capability contemplated herein. U.S. Pat. No. 2,756,693 to E. Frost and U.S. Pat. No. 4,531,869 to D. Hemmings disclose swingable anchor members located in pocket structures. However, these patents do not disclose the water drainage feature in combination with the flame obstruction feature disclosed herein.

I wish it to be understood that I do not desire to be limited to the exact details of construction shown and described for obvious modifications will occur to a person skilled in the art, without departing from the spirit and scope of the appended claims.

I claim:

1. In a flat bed cargo vehicle having a series of upwardly-opening pockets spaced therealong, and a cargo tie-down anchor member pivotably disposed within each pocket for swinging motion between a retracted position located entirely within the pocket and a use position extending partly out of the pocket:

the improvement wherein each pocket is defined by side walls and a bottom wall; said pocket side walls including first and second parallel flat side walls spaced from one another to define the length dimension of the pocket, and third and fourth parallel flat side walls spaced from one another to define the width dimension of the pocket; said bottom wall comprising an upper plate (34) and a lower plate (36); said upper plate angling downwardly from the first pocket side wall to a point beyond the vertical mid plane (38) of the pocket; said lower plate angling downwardly from the second pocket side wall to a point beyond the vertical mid plane of the pocket, said plates having free edge areas spaced from respective ones of the second and first side walls; the plates being dimensioned so that the free edge areas of the plates overlap one another in the vertical direction; the pocket side walls having lower edges thereof no higher than the general plane of the lower plate whereby the space between the free edge of the lower plate and the first side wall forms a restriction to upwardly-moving flames that might otherwise reach the space above the cargo bed; each cargo tie-down member comprising a hub section (30) located above the lower plate in the space between the second side wall and the free edge of the upper plate, and a loop section (28) extending from the hub section; and a pivot shaft (32) extending through the hub section from the third side wall to the fourth side wall to form a pivot axis paralleling the first and second side walls; each cargo tie down member being swingable around the defined pivot axis between a retracted position wherein the loop section rests against the upper plate and a use position wherein the loop section extends upwardly relative to the pivot axis; each hub section having a curvilinear cross section sized to form a first water drainage clearance space (42) between the hub section and the associated second side wall, and a second water drainage clearance space (40) between the hub section and the free edge of the associated upper plate when the tie down member is in its use position or in its retracted position.

2. The improvement of claim 1: each said hub section having a circular cross section with a localized recess (44) therein facing the upper surface of the associated lower plate; each recess forming an enlarged water drainage path aong the facing surface of the lower plate.

3. The improvement of claim 1: the second side wall of each pocket being defined by a side rail of the cargo bed; the second, third and fourth side walls of each pocket being defined by a channel member comprised of a web wall and two flange walls; each channel member being arranged with end areas of the plange walls joined to the side rail.

* * * * *